US005359942A

United States Patent [19]

Ward

[11] Patent Number: 5,359,942

[45] Date of Patent: Nov. 1, 1994

[54] REMOTE CONTROL POSITIONING SYSTEM FOR CONTROLLING HOPPER DOORS

[75] Inventor: Robert J. Ward, Findlay, Ohio

[73] Assignee: DIFCO, Inc., Findlay, Ohio

[21] Appl. No.: 113,216

[22] Filed: Aug. 27, 1993

[51] Int. Cl.[5] ..... B65D 47/00

[52] U.S. Cl. ..... 105/240; 105/241.2; 222/504; 298/35 M

[58] Field of Search ..... 105/240, 239, 241.2, 105/286, 287, 288; 222/504; 298/35 M

[56] References Cited

U.S. PATENT DOCUMENTS

| | | | |
|---|---|---|---|
| 3,173,381 | 3/1965 | Charles et al. | 105/240 |
| 3,433,373 | 3/1969 | Carey et al. | 105/240 |
| 3,446,373 | 5/1969 | Keister et al. | 105/240 |
| 3,596,565 | 8/1971 | Atkinson | 105/240 |
| 5,261,333 | 11/1993 | Miller | 105/287 |
| 5,311,822 | 5/1994 | Bounds | 105/240 |

*Primary Examiner*—Mark T. Le
*Attorney, Agent, or Firm*—Marshall & Melhorn

[57] ABSTRACT

A positioning system for remote operation of hopper doors of a railway car is provided including a radio frequency controller and a hydraulic drive system. The positioning system for each hopper car is supplied with pneumatic power from the locomotive. Pneumatic power is converted to electric power for the controller and hydraulic power for the door drives. The electrical power is a 12 volt DC system provide by a standard battery, which is charged by an alternator driven by an air motor. An air operated hydraulic pump is also connected to the pneumatic power source to supply hydraulic pressure to a valve manifold connected to a series of solenoid operated hydraulic valves. The solenoid operated hydraulic valves are, in turn, connected to hydraulic cylinders which operate doors on railway hopper/ballast or other type cars. The controller includes a receiver for receiving signals from a remote transmitter and operator station. The controller processes the signals and transmits control signals to the solenoid control valve, which causes the cylinders to open or close the desired door.

18 Claims, 3 Drawing Sheets

REMOTE CONTROL POSITIONING SYSTEM FOR CONTROLLING HOPPER DOORS

BACKGROUND OF THE INVENTION

1. Field of the Invention

This invention relates to a remote control positioning system, and more particularly, to a remote control system provided with a hydraulic drive system for positioning the ballast gate doors on a railroad hopper car, and with a radio frequency control system for remote operation.

The present invention utilizes the pneumatic power supply furnished by the locomotive to the railroad hopper cars. The pneumatic power is converted to hydraulic power to drive the hopper doors when opening and closing the doors to selectively discharge ballast material. The radio frequency transmitter and receiver included as part of the system provide an accurate and economical means for achieving remote operating capabilities.

The principal application for the present system is the remote control operation of ballast door mechanisms on railroad hopper cars, which facilitates selective discharge of stone ballast from the railroad hopper cars onto the road bed of a railway. The control system of the present invention may also be used in other hydraulic drive and positioning applications where the available power is a pneumatic power supply, such as large trucks and other similar applications.

2. Description of the Prior Art

A remote control feature is desired in many drive system applications where no source of electrical power is readily available. A railway freight car has a source of compressed air available, i.e. the locomotive air supply, but no source of electrical power. The railway ballast car is a hopper-type railway car where the remote control operation of the hopper gates/doors provides many safety and efficiency benefits.

The need for reballasting of railway road beds results from the loading and unloading of sections of track caused by the passage of wheels of railroad cars traveling on the track. The resultant flexing action of the track tends to force the ballast stone out from under the associated ties. The phenomenon is especially pronounced at the end of the ties, with the result that more ballast is pushed out from under the ties outside the rails than inside the rails. For safe railroad operation, it is necessary to replace the lost ballast. In the early days of the railroad, lost ballast was replenished manually.

When manual reballasting of the road bed was no longer economically feasible, specialized railway cars were developed. These specialized railway cars were provided with hopper doors capable of directing the flow of ballast to the various sections of road bed, including the area between the parallel spaced apart rails, and the area outside the rails. The first of these discharge arrangements were operated manually, such as disclosed in the U.S. Pat. No. 4,452,149 to LeMarbe, and U.S. Pat. No. 4,454,822 to Fischer. While these ballast cars satisfactorily directed the flow of ballast to the various sections of the road bed, the operator was required to walk along side the car as the ballast car moved along the rails. Safety problems arose because of the operator's close proximity, not only to the moving railway car, but to the heavy stone as it was discharged onto the road bed.

These safety problems led to the hydraulic operation of railway ballast cars. The car operator could operate a hydraulic actuated lever some distance away from the discharge area of the ballast gates, and thereby eliminate many of the aforementioned safety problems. An example of such hydraulically operated ballast gates is illustrated in U.S. Pat. No. 5,163,372 to Galvan et al.

An improved hydraulically operated railway ballast car is disclosed in commonly assigned U.S. Pat. application Ser. No. 07/887,358, filed May 21, 1992 now U.S. Pat. No. 5,261,333, in the name of Daniel L. Miller and is specifically incorporated herein by reference. The application discloses the use of an air-operated hydraulic pump, which utilizes the available pneumatic power supply furnished by the locomotive to the hopper car, to power hydraulic cylinders to operate the ballast gate doors. While the use of an air-operated hydraulic pump to supply the hydraulic pressure is an improvement, the operator's presence is still required in close proximity to a moving train. The operator is still endangered both by the moving train and by the ballast as it is discharged from the hopper car.

Thus, those skilled in the art of railway ballast cars continued to search for a solution to the safety problems presented in the use of such cars. The present invention eliminates certain safety problems noted in the prior art by permitting the operator to accurately control the opening and closing of the hopper doors from a distance. The present invention provides a ballast gate positioning system having radio frequency remote operation with means for converting the pneumatic power supply, which is supplied to the hopper car by the locomotive, to electrical power for control operations and to hydraulic power for ballast gate positioning operations.

SUMMARY OF THE INVENTION

A radio frequency remote control positioning system having a pneumatic power supply as the primary source of power is provided for operation of hopper gate doors on a hopper car. Within the positioning system, air motors are used to drive an alternator for charging a DC power supply and to drive a pump for producing hydraulic power.

In the application of the present invention to railway hopper cars, the available pneumatic power supply must be converted to more acceptable forms of power. Electrical power is needed for the radio frequency receiver, and the electrical control circuits for controlling the position of the doors are preferred over both pneumatic and hydraulic controls. From a drive motor standpoint, hydraulic drives are the preferred drive for achieving the desired output performance to position the doors.

For the electrical system, a twelve volt battery is connected in parallel to the alternator, similar to the power system in an automobile. The air motor drives the alternator to continuously charge the battery. The battery provides a constant, low voltage power supply which is required by the radio receiver and electrical control circuits of the present invention. As signals are received from the remote transmitter, the receiver and control circuits of the present invention decode the signal and generate control voltage signals for operation of the control valves to the hydraulic cylinders.

For the hydraulic system, an air motor connected to the pneumatic power source drives a hydraulic pump to convert pneumatic power to hydraulic power. The hydraulic pump circulates fluid to a manifold, and the flow of the fluid to and from the hydraulic cylinders is controlled by operation of the solenoid control valves in the manifold.

The hydraulic cylinders are coupled to the gates/-doors of the hopper, and the movement of the hydraulic cylinder opens and closes the doors. Electrical signals from the control circuits are received at the control valves to direct the positioning of the hydraulic cylinders and the resultant positioning of the hopper doors.

The operator station for remote operation includes a battery powered radio frequency transmitter and control switches to control the opening and closing of the gates/doors. The controller for each of the railway cars may be given a unique digital code (three digit) such that the specific railway car for operation may be selected by the operator using the operator station. Multiple cars may be controlled using a single operator station. The control switches permit the operator to selectively open and close the hopper gate doors on the railway hopper/ballast car.

The control system of the present invention is designed for railway hopper/ballast cars. However, there are a number of other applications where similar control systems are needed. Truck trailers have air supplies available to them and could utilize a similar system for hopper door and other applications.

Therefore, it is an object of the present invention to provide a radio frequency remote control system for applications having only a pneumatic power source of available.

A further object of the present invention is to provide a control system which converts the pneumatic power into electrical power for control and radio frequency receiver use, and which also converts the pneumatic power to hydraulic power for drive cylinder use.

A still further object of the present invention is to provide an improved radio frequency control system which permits the operator to control hopper doors of a railway ballast car from a remote location and to selectively operate hopper doors on multiple railway cars.

Further objects and advantages of this invention will be apparent from the following description and appended claims, reference being made to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENT

The description of the preferred embodiment of the present invention shows a remote control positioning system embodying the present invention described in detail for use with railway hopper/ballast cars transporting and depositing road bed ballast. From the description, it will be easily understood that the present invention can be used for radio frequency control of any type of apparatus where a supply of pneumatic power is available. Such other use includes other types of railway cars, other types of trailers and vehicles, hopper gate/door applications or any other advantageous applications.

Figure 1:
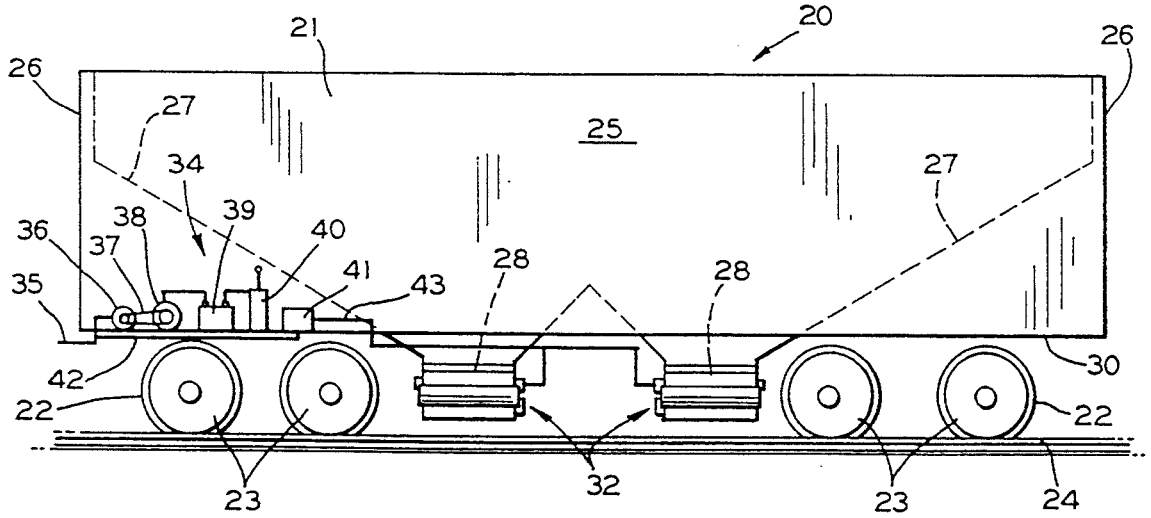
FIG. 1 is a diagrammatic side elevational view showing a railroad hopper car embodying the construction of the present invention.

Referring to FIG. 1, there is shown a conventional hopper/ballast car 20 having a body 21 which is carried on a plurality of spaced apart trucks 22. Wheels 23 of the trucks 22, in turn, are positioned on a pair of rails 24.

Figure 2:
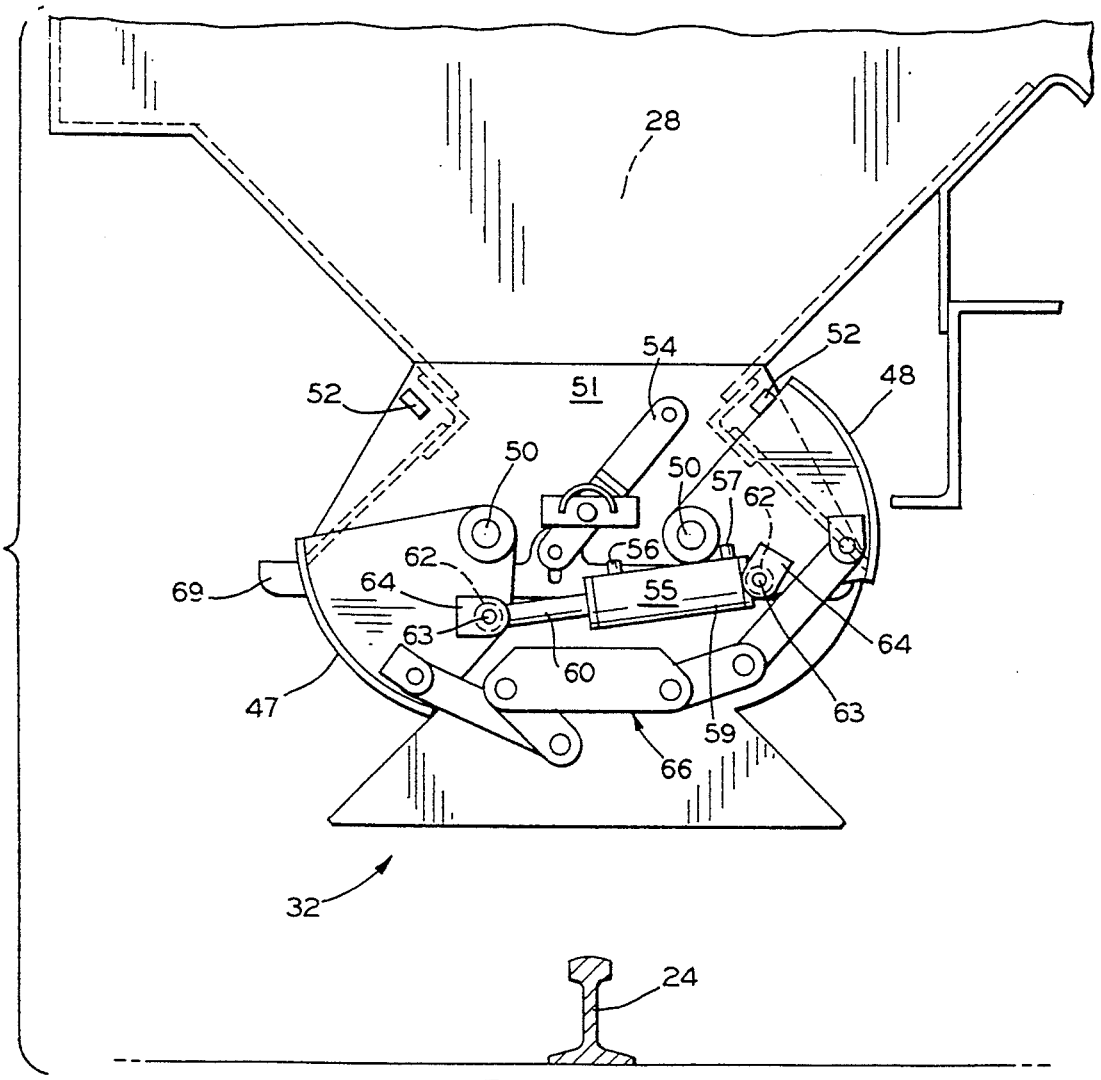
FIG. 2 is an end view of one of the discharge arrangements shown in FIG. 1.

The car body 21 is defined by spaced sidewalls 25 which join end walls 26. The bottom of the car body 21 includes a platform 30 for mounting the car body 21 on the trucks 22. Internal walls 27 and sidewalls 25 define the load-carrying space in the car body 21. The internal walls 27 slope downwardly and terminate to form discharge openings 28 as shown in FIGS. 1 and 2. It should be understood that each car 20 includes four discharge openings 28, and each discharge opening 28 includes a ballast gate 32 with two doors 47, 48. The two discharge openings 28 one on side of the car 20 are aligned with one of the rails 24, while the other two discharge openings on the opposite side of the car 20 are aligned with the other rail 24.

The major components of door positioning system 34 of the present invention are shown in diagrammatic form in FIG. 1. The components are mounted on the platform 30 of the railway hopper car 20 under the sloping internal walls 27. In order to more safely and effectively control the depositing of road bed ballast from the car body 21 through the discharge openings 28 to the rails 24, the positioning system 34 provides remote operation of the doors 47, 48 on ballast gates 32. The pneumatic power supply readily available on the hopper car 20 is converted to electrical power by the air motor 37 and alternator 38 to charge battery 39, which supplies power to controller-receiver 40. Pneumatic power is also delivered to the hydraulic pump 41, which converts the pneumatic power to hydraulic power to drive the hydraulic cylinders 55 used to position the doors 47, 48.

Before discussing the radio frequency positioning system 34 of the present invention in detail, the structure of the ballast gates 32 and the mounting of the hydraulic cylinders SB will be reviewed. Referring to FIG. 2, the ballast gate assembly 32 is similar to the ballast gate assembly disclosed in patent application Ser. No. 07/887,358. An inner door 47 and an outer door 48 are pivotally attached to respective door pivot pins 50 which, in turn, are secured to the ballast gate end wall 51. Door safety stops 52 adapted to limit the upward swing of the associated inner and outer doors 47, 48 are affixed to the end wall S1. A hydraulic cylinder 55 is pivotally attached to the inner and outer doors 47 and 48.

The hydraulic cylinder 55 in this illustrated embodiment is a double-acting hydraulic motor of a type well known in the art having an inner port 56, an outer port 57, a piston 58 slidingly received in a cylinder 59 (all shown schematically in FIG. 5), and a piston rod 60 suitably attached at one end to the piston 58. The other end of the piston rod 60 extends out of the outer end of the cylinder 59 and is secured to a sleeve 62 pivotally mounted on a pin 63 in a support bracket 64 welded to inner door 47.

A sleeve 62 is secured to the end of cylinder 59 which, in turn, is pivotally mounted on a pin 63 in a support bracket 64 attached to the outer door 48. The inner door 47 and the outer door 48 are further connected to a door restraining mechanism, generally indicated at 66 and described in detail in the patent application Ser. No. 07/887,358.

As noted above, each hopper car 20 has four ballast gates 32, with each ballast gate having two doors, an inside door 47 and an outside door 48. The four inside doors 47 are opened to direct ballast material between the rails 24. The four outside doors 48 open to direct ballast material to the outside of rails 24, two doors on each side of the hopper car 20. When distributing ballast material from the hopper car 20 to the tracks 24, the operator can selectively distribute ballast material to either side of the pair of rails 24 or between the rails 24 by opening the desired doors 47, 48 on the ballast gates 32.

There are a number of manual and hydraulic systems known in the art for opening and closing the doors 47, 48 of the ballast gates 32. The radio frequency positioning system 34 of the present invention may be used with any of the systems.

In many cases, a hopper car will have eight hydraulic cylinders, one cylinder connected to each door. In lieu of the eight door cylinders required in many systems, the previously noted patent application Ser. No. 07/887,358 (as shown in FIG. 2), teaches a system in which one door cylinder is connected to the two doors 47, 48 on the ballast gate 32. Only one door may be opened at a time, and operation of either door 47 or door 48 is determined by the position of the control arm 54 linked to locking beam 69. FIG. 2 shows the control arm 54 and locking beam 69 positioned for operation of door 48. Sliding control arm 54 to the other side of gate 32 slides the locking beam 69 to lock gate 48 and permit the operation of gate 47.

For a hopper car 20 with only four hydraulic cylinders, the control arm 54 and locking beam 69 for the four gates 32 are manually positioned by the operator to distribute ballast in the desired position inside or outside of the tracks 24 before the operator moves to a remote location to use the operator station 85 to control the operation of the selected inside door 47 or outside door 48 on the four gates 32.

Figure 3:
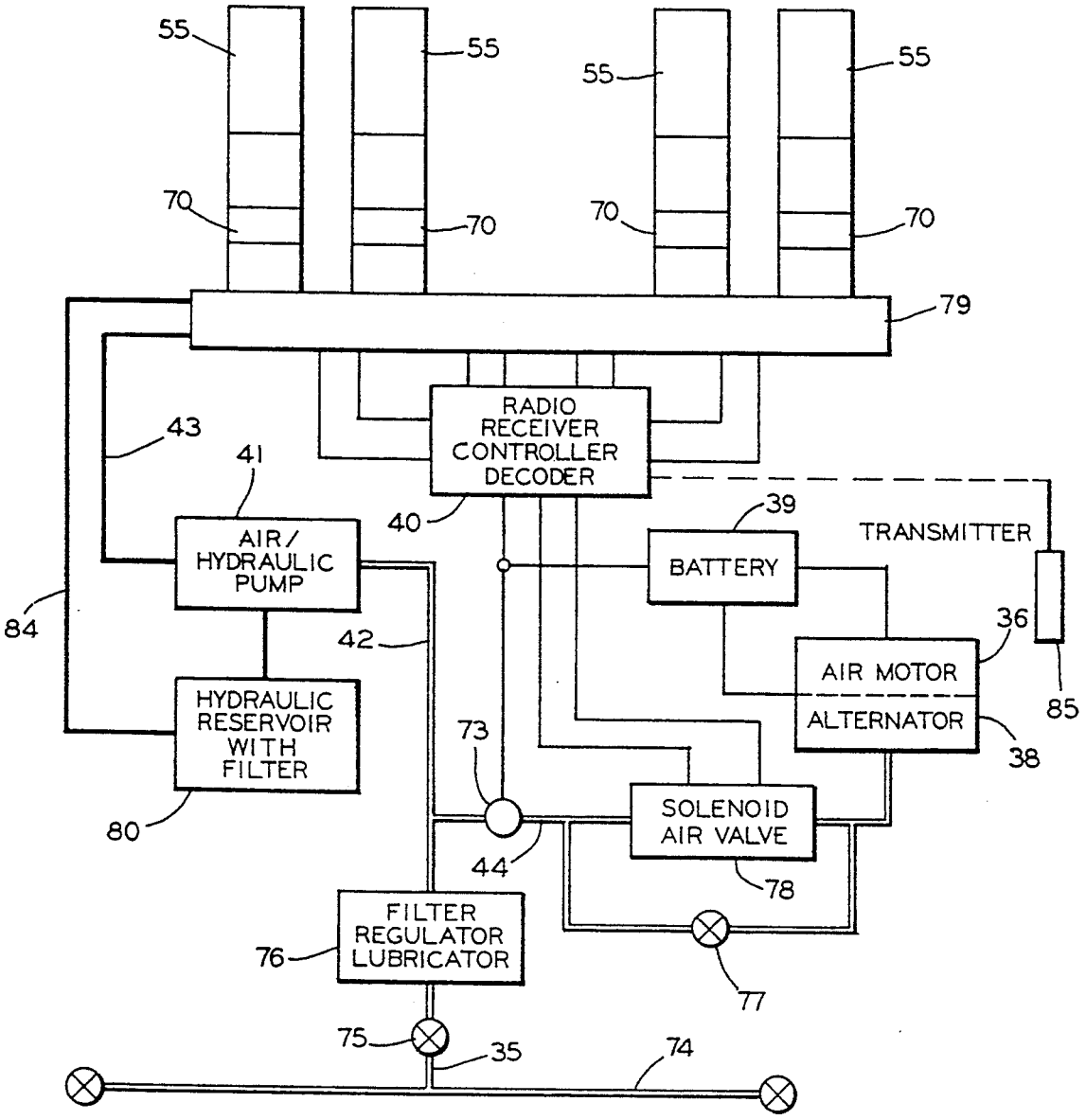
FIG. 3 is a diagrammatic view of a system embodying the present invention.
Figure 4:
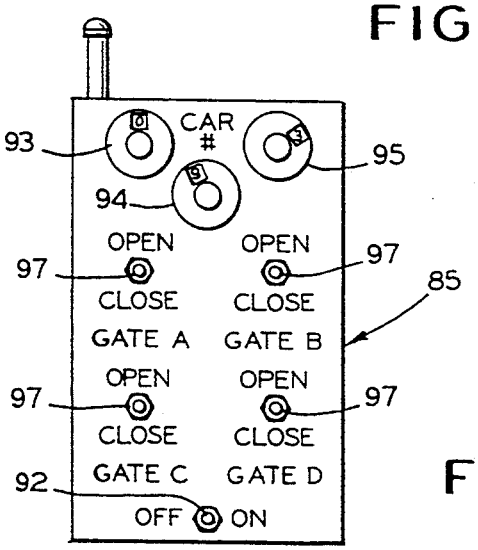
FIG. 4 is an elevational view of a transmitter which may be used to operate the radio receiver/controller shown in FIG. 3.
Figure 5:
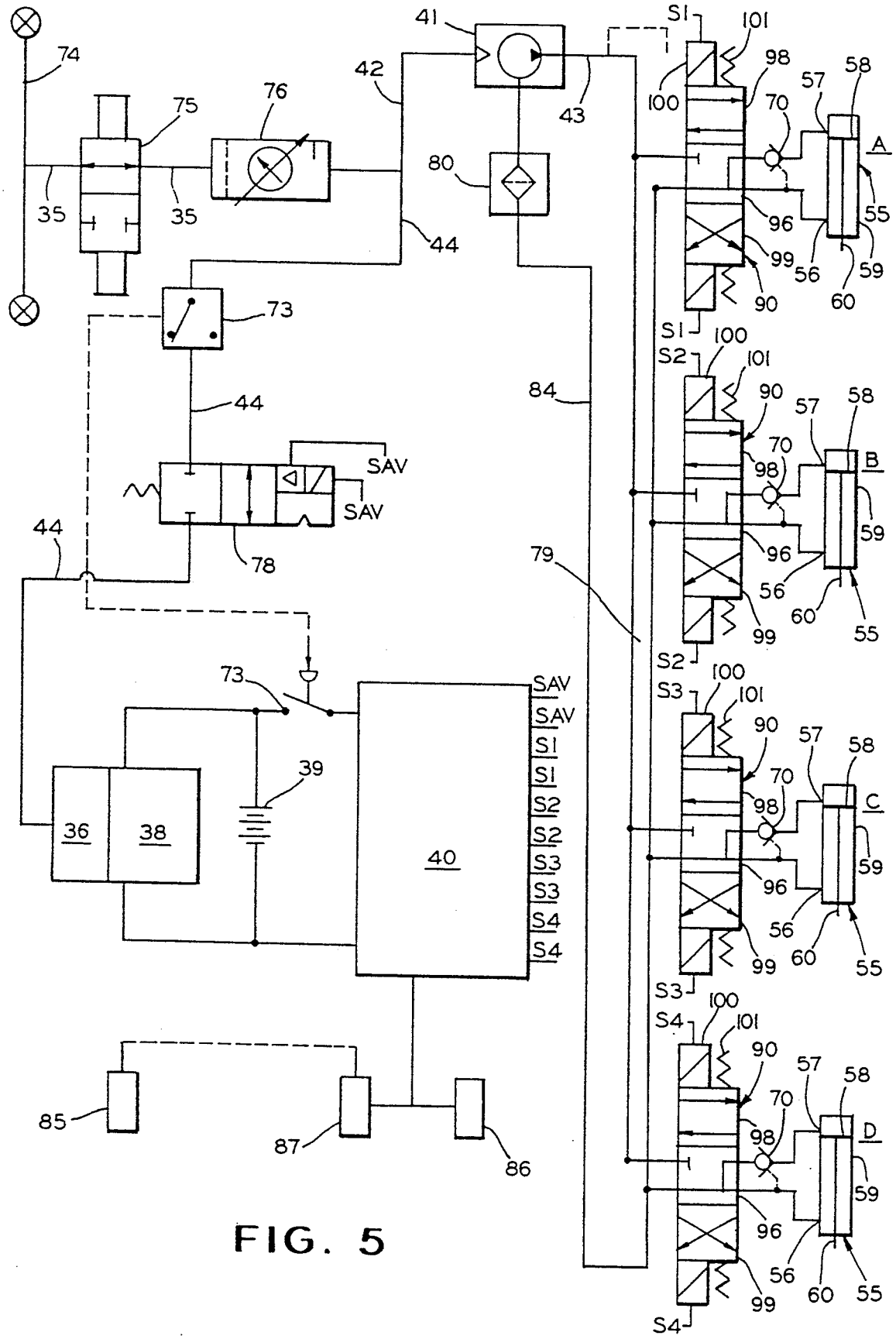
FIG. 5 is a schematic view of the system shown in FIG. 3.

Patent application Ser. No. 07/887,358 provides more details regarding the operation of the gates 32 utilizing only four cylinders 55 to operate eight doors, such as shown in FIGS. 3–5. The application also discloses a positioning system which includes a hydraulic drive system having four door cylinders plus four smaller gate cylinders used to selectively position the control arms of the gates.

For discussion purposes, the positioning system 34 as shown in FIGS. 3–5 includes a controller designed for controlling a hopper door system with four hydraulic cylinders. The hydraulic system and the controller may easily be expanded to include power and control for eight hydraulic cylinders. The control and operation of an eight cylinder system is identical to the operation of the four cylinder system discussed herein. The four cylinder system provides for operation of the four ballast gates without the additional cost of four hydraulic cylinders and the larger hydraulic components necessary to power the system.

In summary, the positioning system 34 of the present invention may be arranged as a four cylinder system using remote radio frequency control system to control the four door cylinders 55. The remote radio frequency control system of the positioning system 34 may also be set up to control eight hydraulic cylinders (either eight door cylinders or four door/four control arm cylinders). The remote control operation of either a four cylinder or an eight cylinder hydraulic subsystem will be readily apparent from the following description.

The door positioning system 34 of the present invention is powered by a pneumatic power supply 74, which in the railroad hopper car application is a locomotive compressed air supply. Pneumatic power systems for trains, which supply and distribute compressed air from the locomotive to the other cars in the train, are known in the industry.

Referring to FIGS. 3 and 5, the pneumatic power conduit 35 is connected to the pneumatic power supply, or main air line 74 which extends from the locomotive in series to other cars in the train. Interposed in the pneumatic power conduit 35 is a normally open valve 75, which controls the entry of the compressed air into the positioning system 34. Valve 75 is maintained in the open position unless the operator desires to manually close the switch to disconnect the pneumatic power, such as to service the system 34.

The filter-regulator-lubricator 76 in conduit 35 removes moisture and contaminants from the air, maintains the minimum pressure required in the system, and adds oil to lubricate the air operated components.

Compressed air is then delivered through the conduit 42 to the air hydraulic pump 41 and through the conduit 44 to the air motor 36 for alternator 38. For the hydraulic system, the regulated compressed air operates the hydraulic pump 41 to pump hydraulic fluid through conduit 43 to the solenoid hydraulic valve manifold 79. The manifold 79 includes solenoid valves 90 to control the flow of hydraulic fluid to and from the hydraulic cylinders 55.

The hydraulic pump 41 is provided with an integral air motor and pump. The hydraulic system typically includes a hydraulic reservoir 80 and hydraulic manifold 79. The hydraulic reservoir 80 stores the hydraulic fluid when the pump 41 is not in operation. Hydraulic pressure is supplied from the hydraulic pump 41 through the conduit 43 and the solenoid valves 90 in manifold 79 to cylinders 55. Hydraulic cylinders 55 are connected to doors 47, 48 of the ballast gates 32.

The hydraulic system includes pilot check valves 70 connected in series between the solenoid valves 90 and the cylinders 55. The check valve 70 is a differential pilot open check valve. When a pressure difference exists between port 56 and port 57, the valve is open. When the pressure is equal at both ports, the valve 70 is closed.

When the hydraulic pump 41 loses power and the pressure drops in power conduit 43, such as when the pneumatic power supply is disconnected, the pilot check valve 70 will be opened to permit hydraulic fluid to leave port 57, which retracts the piston rod 60 and closes the door 47, 48. When the solenoid valve 90 is in the center position 96, the pressure is equal and check valve 70 is closed, which retains piston 60 of the cylinder 55, and doors 47, 48 in the designated position.

The solenoid valve 90 is a spring centered, three position, four port valve. The center position 96 is a closed position, during which there is no hydraulic powered movement of the piston 58 or shaft 60 in the cylinder 55. The conduit 43 is the power line delivering hydraulic power through the valve 90 to the cylinder 55. The center position 96 does have an open return line 84 which is connected to both port 56 and port 57. This equalizes the pressure at both ports 56, 57 when the valve 90 is in the center position 96 and permits any open doors 47, 48 to return to the closed position if the hydraulic system loses power for any reason.

When the coil 100 of solenoid valve 90 is actuated to the right, the valve 90 shifts to the left or door opening position 98. In position 98, valve 90 causes hydraulic fluid to flow into port 57 and out of port 56 to move the piston 58 and extend the piston rod 60 until the coil 100 is de-actuated, at which time the spring return 101 cause valve 90 to return to the middle position 96.

When the coil 100 of solenoid valve 90 is actuated to the left, the valve 90 shifts to the right or door closing position 99. In position 99, valve 90 causes hydraulic fluid to flow into port 56 and out of port 57 to move the piston 58 in the opposite direction and retract the piston rod 60, which closes the door 47, 48. A return line 84 returns the hydraulic fluid to a filter reservoir 80 which is connected to the air-operated hydraulic pump 41.

For the electrical power system and controller 40, conduit 44 is connected to an air motor 36 which drives an alternator 38. The air motor 36 is typically rated 1 horsepower or less with a 0.50 horsepower motor providing sufficient power in most cases. The air motor 36 may utilize a belt drive system 37 or a direct coupling arrangement (not shown) to drive the alternator 38.

Radio frequency controllers for remote operation require an electrical power supply, and will operate on either an alternating current (AC) or direct current (DC) system. Because of the remote location of the hopper cars and the unavailability of a conventional AC power supply, the battery powered DC power supply is the preferred power source. A 12 volt DC system, similar to an automobile system, is utilized in the present invention. A standard 12 volt DC battery 39 provides an electrical source of power. Commercial generators and regulators are one means of providing power to charge the battery 39. It was discovered that an automobile type alternator 38 was a more space efficient and cost effective means of providing power to charge the battery 39.

The alternator 38 is connected in parallel to battery 39. The alternator 38 charges the battery 39 until limited by the regulator (not shown) in the alternator 38 to prevent overload. The battery 39 provides the 12 volt DC power supply needed for operation of the controller 40 and for transmittal of the various control signals.

The battery 39 is connected to controller 40 in series with a pressure switch 73. The controller 40 includes a receiver, decoder, timer and programmable control circuitry for receiving radio frequency signals, for decoding the radio frequency signals, for receiving other input signals (such as the pressure switch), and for transmitting control signals to control the operation of both the electrical system and the hydraulic drive system. The controller 40 will be described in more detail hereinafter.

The pressure switch 73 is interposed in the air supply conduit 44 to monitor the supply of compressed air being supplied to the electrical and hydraulic systems in the overall positioning system 34. When the desired compressed air supply is present, the pressure switch is closed electrically to connect the battery 39 and alternator 38 to the controller 40. When the compressed air supply is not present, the pressure switch 73 disconnects the controller 40 from the battery 39 and alternator 38. This prevents the undesirable drain on the battery and limits operation to when the alternator 38 is operable to charge the battery 39.

Once the pressure switch 73 is closed to connect the battery 39 to the controller 40, the controller 40 is maintained in a stand by mode until a radio frequency signal is received for operational purposes. In the standby mode, a very low current drain occurs until a signal is received from the operator station 85, which is used for remote operation. The battery 39 is able to supply the necessary stand by power for an extended period of time without draining the battery 39.

Interposed between the pressure switch 73 and the alternator 38 is a solenoid actuated air valve 78 which is controlled by the controller 40. When a radio frequency signal is received from the operator station 85, the controller 40 transmits a signal to the solenoid air valve 78 to open the valve and permit the transmission of compressed air to operate the air motor 36 and alternator 38, which charges the battery 39.

The operation of the air motor 36 and alternator 38 continues until the controller 40 transmits a signal to the air valve 78 to open the valve. The controller 40 includes a timing circuit to determine the period of time for which the air valve 78 is opened to operate the air motor 36 and alternator 38. Once the time period specified for operation has been completed, the air valve 78 closes and the controller 40 returns to the standby mode until the next radio frequency signal is received to operate the hydraulic cylinders 55. Every signal received by the controller 40 re-initializes the timing circuit and continues to operate the alternator 38 to charge the battery 39. The timing circuit reduces the operational wear on the air motor 36 and alternator 38, and reduces the overall pneumatic power consumption of the positioning system 34.

The controller 40 shown in FIG. 5 consists of a radio receiver and decoder, plus various control circuits and timing circuits for receiving input signals and decoded radio frequency transmissions and for transmitting signals to the hydraulic valves 90 which control the operation of the hydraulic cylinders 55. The control circuits may include a programmable controller to permit the operator to input performance variables for controller 40 operation, such as the timing or sequence of operation and an access-identification code for each individual hopper car 20.

The radio receiver and decoder in the controller 40 is a standard model, such as a Cattron Model 808 (for controlling four valves-cylinders) or Cattron Model 816 (for controlling eight valves-cylinders). When the pressure switch 73 is open, the electrical power is disconnected and the controller 40 is not operable. When switch 73 is closed, power is supplied to the controller 40 and the controller 40 remains in a stand by mode until a operational signal is received from the operator station 85.

The controller 40 includes an antenna 87 for receiving the radio frequency signals. When the remote radio frequency transmitter in the operator station 85 transmits a signal to the controller 40 through the antenna 87, or when a signal is received from the local push button control station 86, the controller 40 is changed into an operational mode. Control signals are transmitted from the controller 40 over output terminals SAV to open the solenoid air valve 78 to charge the battery 39, as discussed above, which ensures the availability that the necessary 12 volt DC power is available for operational purposes. The operator station 85 then transmits additional signals to instruct the controller 40 as to which cylinder 55 is to be actuated and in which direction the specified cylinder 55 is to be actuated. The controller 40 processes the signals received from the transmitter in operator station 85 and transmits control signals over the appropriate output terminals (S1, S2, S3, S4) to the solenoid valve 90 of the specified cylinder 55.

The operator station 85 is a battery powered unit and includes a standard radio frequency transmitter, such as the Cattron Model 824E-01. The operator station 85 also includes various battery powered control switches for generating signals to be transmitted by the transmitter to the receiver in controller 40. FIG. 4 shows three position, center-throw toggle switches 97 for operating the gates, but other similar control switches would be acceptable for operation of the system.

To prepare the positioning system 34 for operation, the car 20 must be connected to the pneumatic power source 74. The pressure switch 73 is closed, which facilitates the connection of the battery 39 to the controller 40. The controller 40 is in the stand by mode. The compressed air operates the air motor-hydraulic pump 41 to build up the necessary pressure in the hydraulic system. In a four cylinder system, the four ballast gates 32 have to be set for operation of the desired door 47, 48 as noted above. Such step is not necessary if the positioning system 34 is provided with eight cylinders 55 and corresponding controller 40.

If multiple hopper cars 20 are used, then an identification number must be set or programmed in the controller 40 for each of the cars 20 to be operated by the remote operator station 85. Each controller includes an access circuit having an access identification number which may be set manually or programmed into the circuit. The identification number, which is a digital code, must be received and processed by the controller 40 before any further positioning operations will occur.

When one or more cars 20 are in position on the tracks 24 for depositing ballast from car 20 through doors 47, 48, the operator will use the operator station 85 to send a signal from a remote location to the controller 40 on the desired car 20. First, the operator station 85 must be activated using the on/off switch 92 to connect the battery (not shown) in station 85 to the transmitter and the control switches. The operator station 85 is then manually programmed to match the proper digital code to signal the desired car 20. The first selector switch 93 is rotated to set the first digit of the code, the second selector switch 94 is rotated to set the second digit of the code, and the third selector switch 95 is rotated to set the third digit. In this example, the code "093" is shown as being selected.

The next step requires the selection of one of the four gate assemblies for operation. The operator station 85 is provided with four switches 97 (or eight switches 97 to operate eight cylinders). For convenience, the four gates 32 of the hopper car 20 have been designated gate A, gate B, gate C, and gate D on FIG. 4. To operate gate A, the toggle switch 97 designated for gate A is moved to the open position. A signal is generated and transmitted from the operator station 85 to the receiver in controller 40. Since the radio receiver/decoder 40 is now receiving its first signal, the controller 40 is placed in an operational mode. A signal is sent from the output terminals designated "SAV" to open the solenoid air valve 78 for the timed operation of the air motor 36 and alternator 38 to charge the battery 39.

A control signal is transmitted from the appropriate output terminals (S1, S2, S3, or S4) to the coil 100 of solenoid valve 90 to control operation of the solenoid 55 at the specified gate 32. Each hydraulic cylinder 55 may have a corresponding solenoid operated valve 90 to individually control the operation of the cylinders 55. Identical valves 90 are used in the illustrated embodiment. However, it is noted that four separate sets of lines are shown leaving the controller 40 with only one pair of leads going to any one solenoid valve 90. The control signal will actuate the coil 100 of solenoid valve 90 of the appropriate cylinder 55 to the position 98 to allow hydraulic fluid to enter outer port 57 and move the piston 58 and its associated piston rod 60 and cause the outer door 48 (FIG. 2) to open. Since the solenoid valve 90 is a spring return, the switch 97 must be held to the "open" position until the door 48 reaches the desired open position. When the door 48 reaches the desired position or the door 48 is in the fully opened position (hitting the door safety stops 52), the switch 97 is returned to its middle or neutral position and the solenoid valve 90, with springs 100, returns to the middle position 96.

When it is desired to close the door 48, the switch 97 is moved to the "close" position which causes a signal to be transmitted from the operator station 85 through the controller 40 to the coil 100 of solenoid valve 90, which shifts the valve 90 to the position 99. Hydraulic fluid enters port 56, actuating the piston 58 and shaft 60 to move the door 48 to the closed position.

It can easily be understood that the rest of the hydraulic cylinders or motors 55 operate in an identical fashion. The use of three position valves 90 insures that the doors cannot be moved accidentally when the switch 97 is in its neutral position. The check valves 70 insure that the door 48 stays in the desired position until further signals are received or until the door 48 closes due to loss of hydraulic power.

The operator station 85 may use a variety of switch arrangements. For example, an operator station 85 for an eight cylinder system may include eight center throw switches 97. In the alternative, the operator station 85 may control eight cylinders by utilizing a four position selector switch to select one of the four gates 32, a two position selector switch to select either inside door 47 or outside door 48 of the gate 32, and a single center throw switch 97 to open and close the selected door.

In addition to remote operation, a local push button control station 86 electrically connected to the controller 40 and mounted on the car 20 could also be included to control the operation of the doors 47, 48 to gate 32. The station 86 uses a similar switching system to selectively operate the cylinders 55 to position the doors 47, 48.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A radio frequency controlled positioning system utilizing a pneumatic power supply to position doors on a hopper car, said system comprising:

a) a pneumatic power supply for supplying power to the system;

b) pressure fluid power means for converting pneumatic power to pressure fluid power, connected to said pneumatic power supply;

c) electric power means for converting pneumatic power to electric power, connected to said pneumatic power supply;

d) a pressure fluid drive system connected to said pressure fluid power means, said pressure fluid drive system including one or more motor means, each motor means being coupled to a door for selectively effecting the motion of the door between an open and a closed position, whereby the actuation of the motor means determines the position of the door;

e) a controller connected to said electric power means and in electrical communication with said pressure fluid drive system, said controller including a radio frequency receiver for receiving remote signals, and a processor for processing the remote signals and transmitting control signals to said pressure fluid drive system to control the movement of the motor means; and f) a remote operator station, said operator station including a radio frequency transmitter and control switches for transmitting remote signals from said operator station to the receiver in said controller, whereby the positioning of the doors is controlled by said remote operator station.

2. The positioning system defined in claim 1 wherein said electric power means includes a battery connected to said controller whereby the battery supplies power to said controller.

3. The positioning system defined in claim 2 wherein said electric power means includes an air motor connected to said pneumatic power supply and coupled to an alternator, the alternator being connected to said battery, whereby the air motor drives the alternator to charge the battery and maintain a constant direct current power supply to the controller.

4. The positioning system defined in claim 1 including a pressure switch pneumatically connected to the pneumatic power supply, and electrically connected between the electric power means and said controller, whereby the pressure switch disconnects said electric power means from said controller to prevent operation of the positioning system when said pneumatic power supply decreases below a selected pressure.

5. The positioning system defined in claim 4 including an air control valve pneumatically connected in series with the pressure switch between the pneumatic power supply and the electric power means, and electrically connected to said controller, whereby the air control valve receives signals from the controller to open the valve for supplying pneumatic power to the electric power means and to close the valve when the positioning system is not in operation.

6. The positioning system defined in claim 5 wherein said controller includes a stand by mode and an active mode, and said remote operator station includes an on-off switch, whereby said controller is in a standby mode when the switch is in the off position and in the active mode when the switch is in the on position.

7. The positioning system defined in claim 5 wherein said controller includes a timer for controlling an operating cycle of the air control valve, whereby the control valve is signaled to open for a selected period of time and then is signaled to close until further signals are received from the controller.

8. The positioning system defined in claim 1 wherein said pressure fluid power means is a hydraulic power means with hydraulic fluid, the pressure fluid drive system is a hydraulic drive system, and the motor means is a hydraulic cylinder.

9. The positioning system defined in claim 8 wherein said hydraulic power means includes an air operated hydraulic pump connected to said pneumatic power supply, whereby the hydraulic pump provides hydraulic power to said hydraulic drive system.

10. The positioning system defined in claim 9 wherein said hydraulic drive system includes a control valve connected to each hydraulic cylinder for the selective transmission of hydraulic fluid from the hydraulic power means to the hydraulic cylinder whereby the actuation of the hydraulic cylinder is controlled by the control valve.

11. The positioning system defined in claim 10 wherein said hydraulic drive system includes a hydraulic valve manifold connected to the hydraulic pump and in fluid communication with the control valves, the manifold directing hydraulic fluid of the hydraulic power means to the control valves for selective delivery to the hydraulic cylinders.

12. The positioning system defined in claim 11 wherein said hydraulic cylinders are double acting hydraulic cylinder to facilitate the controlled opening and closing of the doors.

13. The positioning system defined in claim 10 wherein the control valves in said hydraulic drive system are spring centered, three position, four port valves.

14. The positioning system defined in claim 10 including a check valve connected between the control valve and the hydraulic cylinder.

15. The positioning system defined in claim 1 including a regulator connected to said pneumatic power supply whereby pneumatic pressure supplied to said hydraulic power means and said electric power means is regulated.

16. The positioning system defined in claim 1 wherein said controller includes a local operator station mounted on said controller for transmitting electrical signals to the central processing unit, whereby the positioning of the cylinders may be controlled by either the local operator station or the remote operator station.

17. The positioning system defined in claim 1 wherein the radio transmitter includes means for transmitting a digital identification code and the radio receiver includes means for receiving a digital identification code and transmitting the code to an access circuit in the controller, whereby the receiver and controller are activated when the transmitter identification code is identical to the access circuit identification code.

18. A radio frequency controlled positioning system utilizing a pneumatic power supply to position doors on a plurality of hopper cars, said system comprising:

a) a pneumatic power supply for supplying power to each of the hopper cars;

b) hydraulic power means mounted on each hopper car for converting pneumatic power to hydraulic power, said hydraulic power means being connected to said pneumatic power supply;

c) electric power means mounted on each hopper car for converting pneumatic power to electric power, said electric power means being connected to said pneumatic power supply;

d) a hydraulic drive system mounted on each car and connected to said hydraulic power means, said hydraulic drive system including one or more hydraulic cylinders, each hydraulic cylinder being coupled to a door for selectively effecting the motion of the door between an open and a closed position, whereby the actuation of the hydraulic cylinder determines the positioning of the door;

e) a controller mounted on each hopper car and connected to said electric power means and in electrical communication with said hydraulic drive system, said controller including a radio frequency receiver for receiving remote signals, an access circuit having a unique digital identification code, and a central processing unit for processing remote signals and transmitting control signals to said hydraulic drive systems to control the movement of the hydraulic cylinders; and f) a remote operator station, said operator station including a radio frequency transmitter provided with means for transmitting a selected digital identification code to match the digital identification code of the access circuit on one of the hopper cars, the transmitter transmitting remote signals from said operator station to the receiver in said controller, whereby the positioning of the doors on the desired hopper car is controlled by said remote operator station when the transmitted identification code matches the identification code of the access circuit to the controller.

* * * * *